US008523602B2

(12) United States Patent
Figie

(10) Patent No.: US 8,523,602 B2
(45) Date of Patent: Sep. 3, 2013

(54) FIELD INSTALLABLE CONNECTOR BACKSHELL SHIELD FOR MOTOR DRIVE

(75) Inventor: John R. Figie, New Berlin, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 13/447,185

(22) Filed: Apr. 14, 2012

(65) Prior Publication Data

US 2012/0276778 A1 Nov. 1, 2012

Related U.S. Application Data

(60) Provisional application No. 61/476,076, filed on Apr. 15, 2011.

(51) Int. Cl.
*H01R 13/58* (2006.01)

(52) U.S. Cl.
USPC ..... 439/466

(58) Field of Classification Search
USPC ..... 439/466, 465, 469, 460, 441, 473, 439/596, 902, 948
See application file for complete search history.

(56) References Cited

U.S. PATENT DOCUMENTS 3,904,265 A * 9/1975 Hollyday et al. ..... 439/469
4,761,145 A * 8/1988 Goto et al. ..... 439/469
4,822,286 A * 4/1989 Bianca ..... 439/607.45
4,952,168 A * 8/1990 Schieferly et al. ..... 439/467
5,315,062 A * 5/1994 Hoshino ..... 439/446
6,354,879 B1 3/2002 Plehaty
6,705,894 B1 3/2004 Comerci et al.
7,052,323 B1 5/2006 Ruff et al.
7,112,086 B1 * 9/2006 Wu ..... 439/460
7,485,003 B2 2/2009 Mandrusov et al.

OTHER PUBLICATIONS

2009/2010 Phoenix Contact Catalog, pp. 708-709 (2009).
Phoenix Contact Catalog, D-Sub Sleeve Housings, pp. 1-2, (Feb. 7, 2012).
Connection Technology for Field Devices and Field Cabling, pp. 436, 437,440-443 (2011).

* cited by examiner

*Primary Examiner* — Tulsidas C Patel
*Assistant Examiner* — Phuongchi T Nguyen
(74) *Attorney, Agent, or Firm* — Fay Sharpe LLP; R. Scott Speroff; John M. Miller

(57) ABSTRACT

A field installable backshell connector for a shielded cable provides an EMI shield around control signal conductors and a plastic connector of the cable and also provides a mechanical terminal of the cable. The backshell connector provides a low impedance ground path from the cable shield to a connector socket. The connector socket includes a plastic connector header that is shielded by a grounded metal shroud. When connected to the socket, the backshell is abutted with the connector socket shroud to complete the low impedance ground path from the cable shield in order to shunt electrical noise introduced on the cable shield, connector backshell and shroud to ground to resist electrical interference.

21 Claims, 7 Drawing Sheets

FIELD INSTALLABLE CONNECTOR BACKSHELL SHIELD FOR MOTOR DRIVE

CROSS-REFERENCE TO RELATED APPLICATION

This application claims priority from and benefit of the filing date of U.S. provisional application Ser. No. 61/476,076 filed Apr. 15, 2011, and the entire disclosure of said provisional application is hereby expressly incorporated by reference into the present specification.

BACKGROUND

Servo motors include a motor coupled to an encoder that outputs feedback signals to enable precise speed and position control of the motor. Typically, a servo motor drive system includes a servo motor (e.g., a 3 phase permanent magnet AC motor and position encoder) wired to a servo drive (sometime referred to simply as a "drive"), wherein the drive provides a controllable source of AC power in response to a feedback signal output by the encoder using, e.g., a PID motor control algorithm. The drive may be installed in an equipment cabinet and connected to an input source of AC power. The AC power is provided from the drive to the motor through power conductors, and a separate shielded signal conductor returns the encoder feedback signals to the drive. A need has been identified for an improved arrangement for connecting a servo drive to an associated servo motor to provide for simplified and reduced cost installation and maintenance, while providing good overall performance.

SUMMARY

In accordance with a first aspect of the present development, a field installable cable connector backshell includes a metallic shell comprising a base and a cover connected to the base. The base includes a recess and the shell defines an envelope around and enclosing the recess when the cover is operably connected to the base. The shell further comprises a first end including a connector opening that opens through the shell into a first portion of the recess and a mouth that opens through the shell into a second portion of the recess. The mouth allows passage of an associated cable terminal end into the recess. The shell further comprises first and second flanges located adjacent the first end and projecting laterally outward in opposite first and second directions, respectively. The first and second flanges comprise respective first and second captured fasteners adapted for releasably engaging an associated connector socket. The first portion of the recess is located adjacent the connector opening and includes a connector seat that comprises a portion of a floor of the shell base. The connector seat is located on the floor between first and second spaced-apart side walls of the base that project outwardly on opposite sides of the floor, the connector seat adapted to receive and support an associated plug connector located on the associated cable terminal end such that a projecting plug portion of the associated plug connector projects through the connector opening outside the shell. A portion of the cover of the shell is adapted to contact the associated plug connector located on the seat when the cover is connected to the base. The shell further comprises an electrical shield contact structure located in the recess and adapted for contacting the electrical shield surrounding the associated cable terminal end located in the recess and electrically connecting the electrical shield of the associated cable to the shell such that the shell defines an electromagnetic interference shield around the associated cable terminal end located in the recess.

In accordance with a second aspect of the present development, a servo motor drive system includes a servo motor drive comprising a drive connector socket and a shielded control signal cable including a backshell connector engaged with the drive connector socket. The shielded control signal cable includes an electrical shield surrounding control signal conductors. The backshell connector establishes an electromagnetic interference shield envelope around the control signal conductors, and the backshell connector and drive connector socket cooperate to provide a low impedance electrical connection path from the electrical shield of the control signal cable to a ground path of the servo motor drive. The drive connector socket includes a plastic connector header including connector pin sockets located in a front face, and includes a metal shroud that provides an electromagnetic interference shield for the plastic connector header. The metal shroud includes first and second spaced-apart side walls that cover left and right sides of the plastic connector header, a rear wall that covers a rear surface of the plastic connector header, a top wall that covers a top surface of the plastic connector header, and a front wall that covers part of the front face of the plastic connector header. The front wall of the metal shroud includes a window that provides access to the connector pin sockets in the front face of the plastic connector header. The metal shroud includes at least one ground connection to a ground path associated with the servo motor drive. The backshell connector of the control signal cable includes a metallic shell including a base and a cover connected to the base. The base includes a recess and the shell defines an envelope around and enclosing the recess when the cover is operably connected to the base. The shell further includes a first end including a connector opening that opens through the shell into a first portion of the recess and includes a mouth that opens through the shell into a second portion of the recess. A terminal end of the control signal cable extends through the mouth into the recess. A plug connector is operably engaged with first and second control signal conductors of the control signal cable. The plug connector is located in the recess with a plug portion thereof projecting out of the shell through the connector opening and is operably mated with the pin sockets of the drive connector socket. The first end of the shell is abutted with the front wall of the metal shroud of the connection socket to complete a low impedance ground path between the shell and the metal shroud. The shell further includes an electrical shield contact structure located in the recess and adapted for contacting an electrical shield surrounding the cable terminal end located in the recess, the electrical shield contact structure electrically connecting the electrical shield of the cable to the shell such that the shell defines an electromagnetic interference shield around the cable terminal end located in the recess, and such that the electrical shield of the cable is grounded through the shell to the metal shroud of the drive connector socket.

In accordance with another aspect of the present development, a connector assembly for coupling a control cable to an industrial automation device is provided. The control cable includes at least two control data lines and a ground shield surrounding the data lines. The assembly comprises a polymeric connector mechanically secured to the cable in electrical communication with respective data lines. A polymeric connector header is mounted to a printed circuit board of the industrial automation device and includes a plurality of connection sockets. A metallic backshell surrounds the polymeric connector and is in electrical communication with the ground shield of the cable. A metallic shroud encompasses the connector header and includes a first surface interposed between the polymeric connector header and the metallic backshell when the polymeric connector mated with the polymeric connector header to establish electrical continuity between the metallic backshell and the metallic shroud. The metallic backshell and the metallic shroud cooperate to provide a continuous electrical grounding envelope from the cable ground shield around the polymeric connector and polymeric connector header to a ground path.

DETAILED DESCRIPTION

Figure 1:
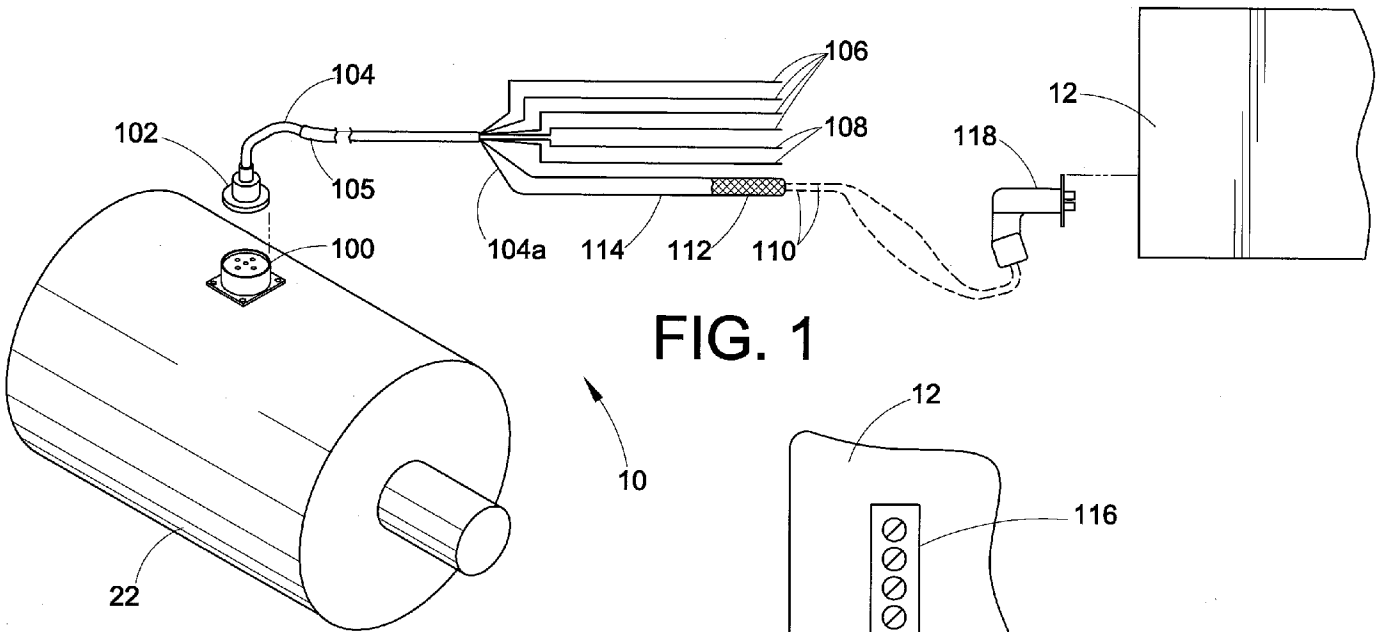
FIG. 1 illustrates a servo motor drive system provided in accordance with the present development.

FIG. 1 illustrates a servo motor drive system 10 comprising a servo drive or drive 12 that controls an associated servo motor 22. Unlike known systems in which multiple separate conductors are used to operably interconnect the drive 12 to the motor 22 for transmission of power and data there between, the system 10 comprises a single, new and improved hybrid cable 104 that provides all necessary power and data conductor between the drive 12 and the motor 22. As shown, the hybrid cable 104 comprises multiple internal conductors 106, 108, 110 housed in an outer insulating and protective sheath 105. The internal conductors include primary power conductors 106 for providing power to the windings of the servo motor 22 and optionally ancillary power conductors 108 for providing power to an internal brake or other part of the servo motor 22. The cable 104 further includes two or more signal conductors 110 providing electronic feedback signals from sensors or the encoder of the motor 22 to the drive 12. The signal conductors 110, which are insulated from each other, are also surrounded by an electrical shield 112 and an external insulation sleeve 114 which is, itself, contained within the protective and insulative sheath 105 of the hybrid cable 104. As such, the signal conductors 110, their electrical shield 112, and their external insulation sleeve 114 are referred to herein as a control signal cable or cable portion 104*a* of the hybrid cable 104.

Figure 1A:
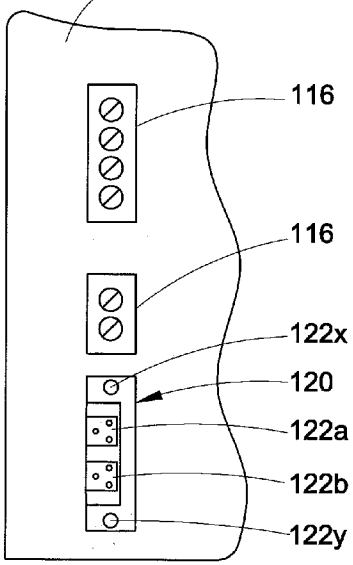
FIG. 1A is a partial rear view of a servo drive portion of the system of FIG. 1.

At a first (motor) end of the cable 104 connected to the motor 22, the cable 104 includes a factory installed connector 102 to make all required power and data connection with the motor. The connector 102 is not suitable for use at the opposite drive end of the cable 104 and is not able to be installed on the cable by a field technician, i.e., it is not field installable on the cable 104 or cable portion 104*a*. At the drive end of the cable 104 connected to the drive 12, the cable is split or bifurcated, with the conductors 106, 108 forming a first branch and being operably connected to power connectors on the drive 12, e.g., to terminal blocks 116 of the drive 12 as shown in FIG. 1A. The signal conductors 110 are operably connected to a drive connector socket 120 of the drive 12 by way of a field installable cable connector 118 that is fixedly secured to and operably connected with the signal conductors 110 according to the present development.

Figure 2A:
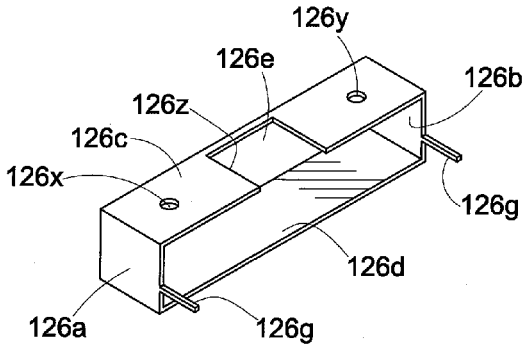
FIG. 2A shows a header shroud portion of the drive connector socket by itself.
Figure 2:
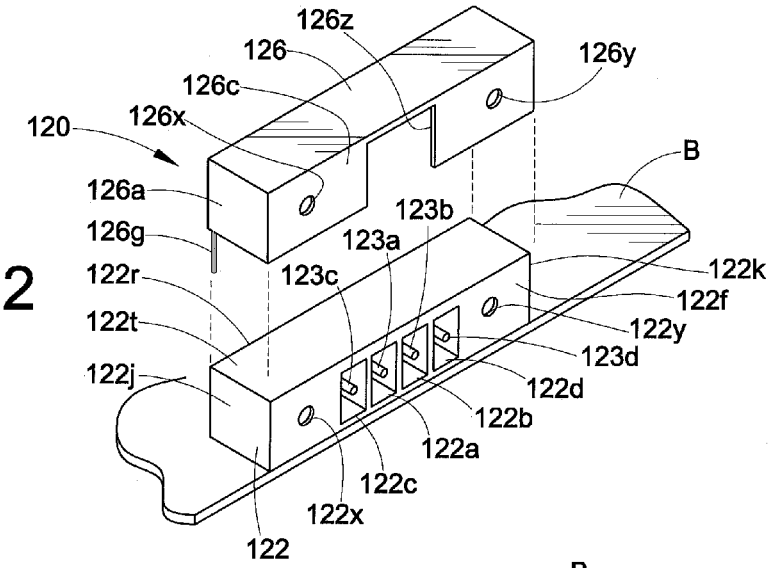
FIG. 2 is an exploded view of a feedback signal drive connector socket constructed in accordance with the present development as installed on a circuit board of a servo drive of the system of FIG. 1.

FIGS. 1A and 2 show a novel and unobvious drive connector socket 120 structured according to the present development. In particular, the drive 12 includes an internal circuit board B to which a polymeric (i.e., "plastic") socket header 122 is electrically connected. The header 122 comprises a front face 122*f* including at least two pin sockets 122*a*, 122*b* comprising respective pins 123*a*, 123*b* that are electrically connected to the circuit board B. The header 122 optionally comprises additional pin sockets such as 122*c*, 122*d* comprising respective pins 123*c*, 123*d* that are not electrically connected to the circuit board B and/or that are grounded through the circuit board B or another ground path. Unlike known connector sockets for servo drives, the connector socket 120 further comprises an electrical overshield or shroud 126 defined from a conductive metal and structured to completely encase the header 122 in order to provide an electromagnetic interference (EMI) shield structure around the plastic header 122. The shroud 126 is electrically grounded through an electrical connection with the circuit board B or another ground path such as a chassis to which the drive 12 is connected.

Figure 3:
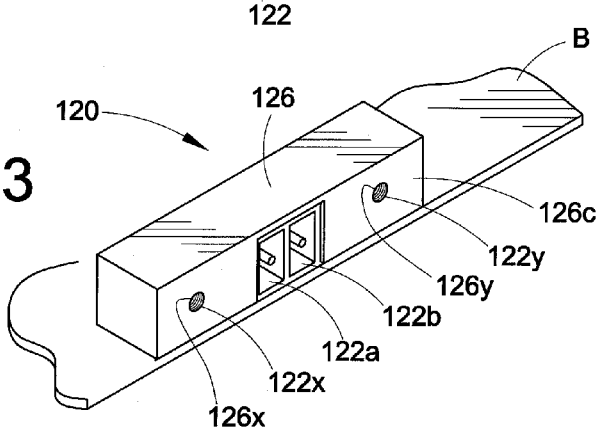
FIG. 3 provides a fully assembled view of the drive connector socket of FIG. 2.

FIG. 2 shows the shroud 126 in an exploded position relative to the plastic header 122. FIG. 2A shows the header shroud 126 by itself. FIG. 3 shows the shroud operably connected to the header 122 and the circuit board B. The shroud 126 is provided by a one-piece metallic structure defined from nickel plated brass or another suitable metal and comprises a first and second parallel spaced-apart side walls 126*a*, 126*b*, parallel spaced-apart front and rear walls 126*c*, 126*d* that extend between and interconnect the side walls 126*a*, 126*b*, and a top wall 126*e* that lies perpendicular to and that interconnects the side walls 126*a*, 126*b* and the front and rear walls 126*c*, 126*f*. To provide an effective EMI (electromagnetic interference) shield, the side walls 126*a*, 126*b*, the rear wall 126*d*, and the top wall 126*e* are uninterrupted and continuously defined, without openings or interruptions, and are coextensive with the corresponding adjacent underlying left and right side walls 122*j*, 122*k*, rear wall 122*r*, and top surface 122*t* of the plastic header 122. The front wall 126*c* comprises only the minimum size and number of openings required to use the connector 120. More particularly, the front wall 126*c* comprises first and second apertures 126*x*, 126*y* that are respectively aligned with corresponding threaded connector securement apertures 122*x*, 122*y* defined on opposite lateral sides of the pin sockets 122*a*-122*d*, and further comprises an opening or window 126*z* that provides access to the minimum number of required pin sockets 122*a*-122*d* to operate the servo drive motor system 10, in this case the two central sockets 122*a*, 122*b*. It is important to note that the front wall 126*c* completely covers any and all unused sockets 122*c*, 122*d* of the header 122. The shroud 126 further comprises one or more ground pins 126*g* that are each connected to one of the walls 126*a*-126*e* (side walls 126*a*, and 126*b* in the illustrated embodiment) and that are electrically connected to a ground path of the drive circuit board B to which the connector socket 120 is operably connected or another ground path.

Figure 4A:
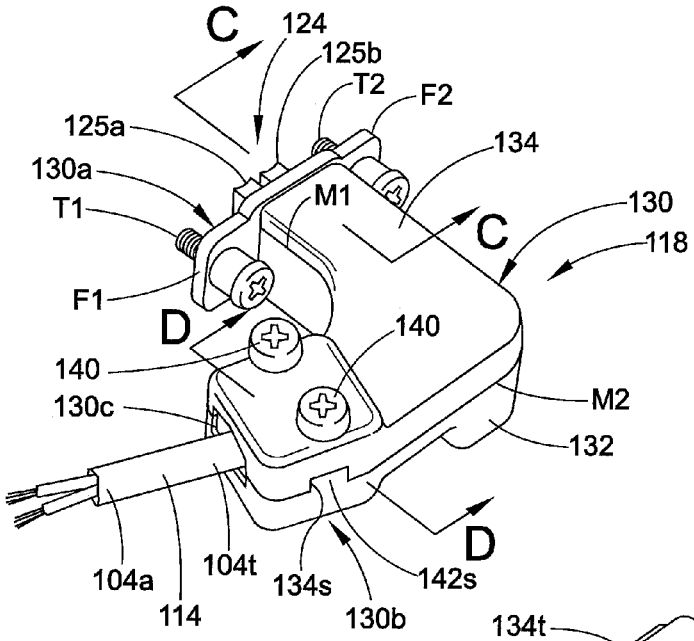
FIG. 4A is an isometric view of a field installable cable connector formed in accordance with the present development.
Figure 4B:
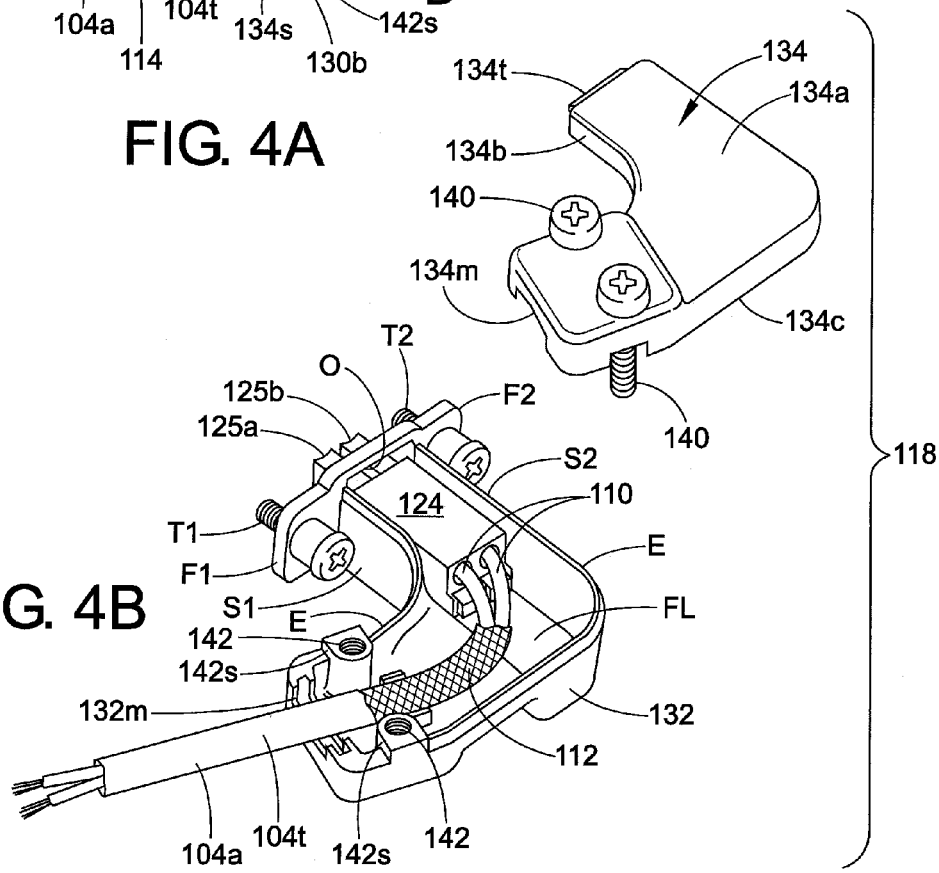
FIG. 4B is an exploded isometric view of the connector of FIG. 4A.

FIG. 4A provides an isometric view of the field installable cable connector 118 formed according to the present development, and FIG. 4B provides an exploded view of the connector 118. The cable connector 118 comprises a two-piece metallic shell 130 defined from die-cast aluminum or another suitable metal. The shell 130 comprises a first shell portion or base 132 and a second shell portion or cover 134 that is selectively releasably connected to the base 132 to define the overall shell 130.

The shell 130 comprises a first or inner end 130*a* adapted to be located adjacent and abut the drive connector socket 120 and comprises a second or outer end 130*b* spaced from the inner end 130*a* and comprising a mouth opening or mouth 130*c* adapted to receive the terminal end 104*t* of the control signal cable portion 104*a* of the hybrid cable 104, i.e., the signal conductors 110, their shield 112, and the surrounding insulation sleeve 114. In particular, as described in further detail below, the shell 130 is adapted to make an electrically conductive termination connection with contact around the circumference of the electrical shield 112 of the control cable 104*a*, preferably with 360 degrees of contact but at least enough to provide a low impedance connection to the electrical shield so that the shell 130 provides an effective EMI envelope or EMI shield to prevent electrical interference from reaching the signal conductors 110 located inside the shell 130 and to provide a low impedance path to shunt noise currents introduced on the control cable shield 112 to ground.

Figure 5A:
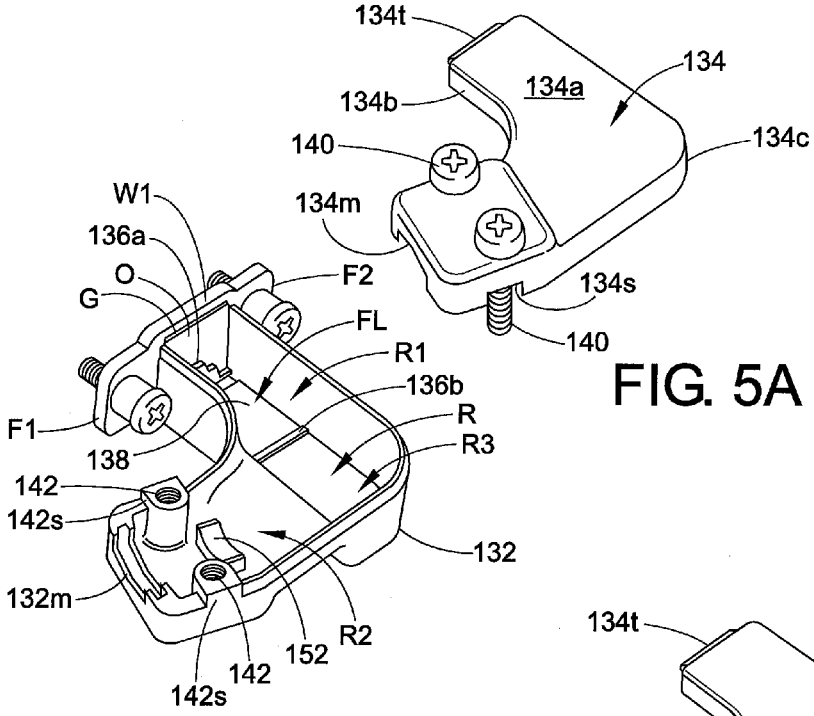
FIG. 5A is an exploded isometric view of a shell portion of the connector of FIG. 4A.

FIG. 5A is similar to FIG. 4B but shows the shell 130 in an empty condition. The base 132 of the shell 130 is, itself, a one-piece structure that includes first and second side walls S1, S2 and a floor FL that extends between and interconnects the side walls S1, S2 so that a recess R is defined. The first and second side walls each comprise an upper edge E spaced from the floor FL. The base 132 further comprises a flange F located adjacent its first or inner end 132*a* that projects outwardly in first and second opposite lateral directions therefrom. The flange F comprises first and second ears or flange portions F1, F2, wherein the first flange F1 portion projects perpendicularly outward from the first side wall S1 and the second flange F2 projects perpendicularly outward from the second side wall S2. The base 132 further comprises first and second threaded fasteners T1, T2 that extend respectively through and that are respectively captured to the first and second flanges F1, F2, and that are selectively threaded into the connector securement apertures 122*x*, 122*y* of the connector socket 120 to fixedly secure the flange F to the drive connector socket 120 as described below.

The shell base 132 is substantially L-shaped such that the recess R comprises a first portion R1, a second portion R2 that extends transversely relative to the first portion R1, and an elbow portion R3 that defines at least a 90 degree turn that connects the first and second recess portions R1, R2. The first recess portion R1 extends transversely outward away from the flange F and the second recess portion R2 extends transversely relative to the first recess portion R1 such that the first side wall S1 defines an internal angle of 90 degrees or less between a first portion thereof in the region of the first recess portion R1 and a second portion thereof in the region of the second recess portion R2. This L-shaped structure of the base 132 reduces the space required adjacent the drive 12 for mating the cable connector 118 with the drive connector socket 120.

As noted, the signal conductor cable portion 104*a* feeds into the shell 130 through a mouth 130*c*. The mouth 130*c* is defined between a mouth recess 132*m* defined in the base 132 and a corresponding mouth recess 134*m* defined in the cover 134.

Figure 4C:
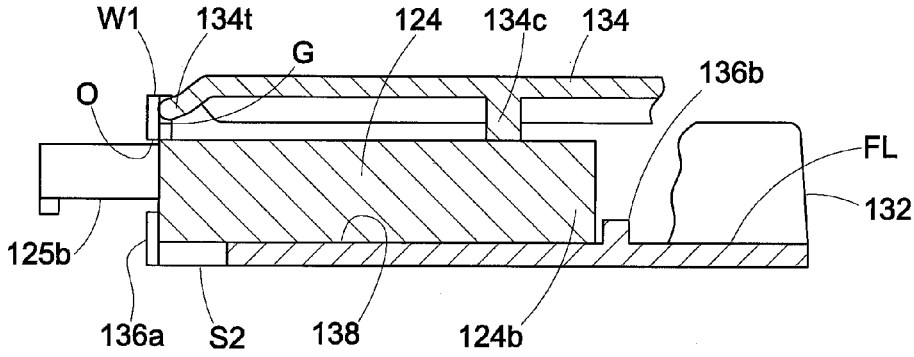
FIG. 4C is a section view taken at line C-C of FIG. 4A.
Figure 4D:
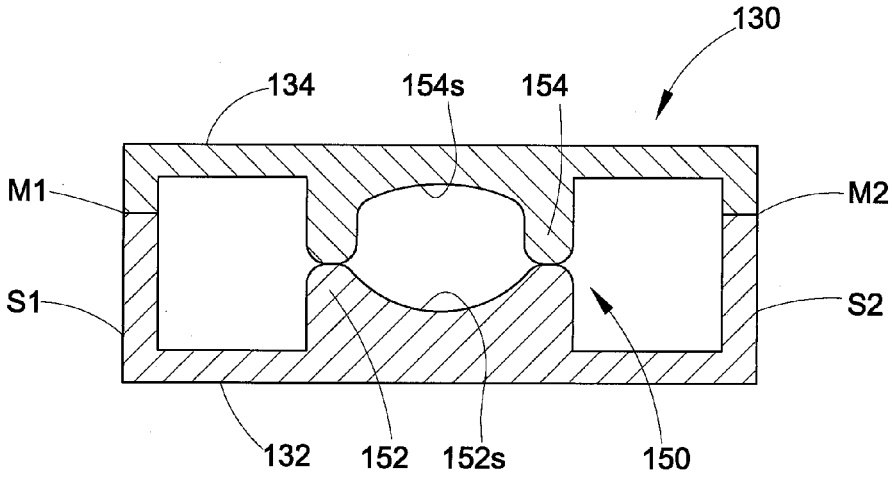
FIG. 4D is a section view taken at line D-D of FIG. 4A.
Figure 5B:
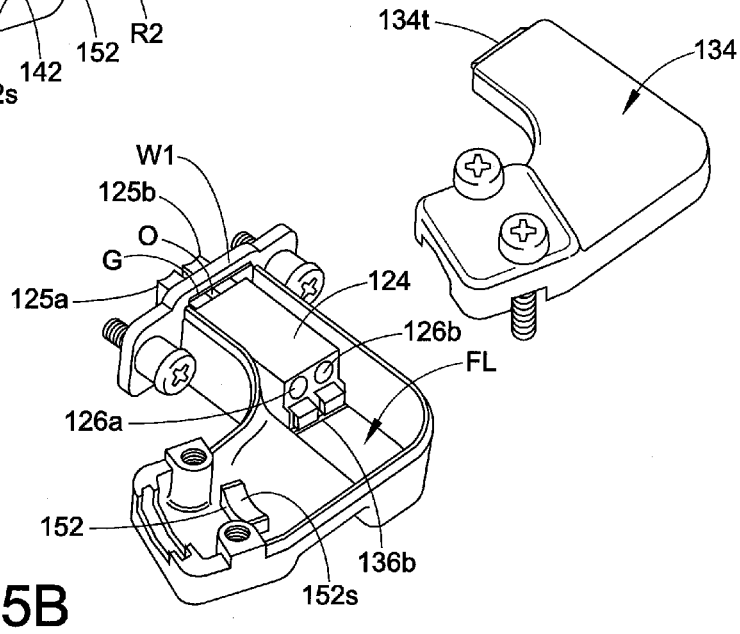
FIG. 5B is similar to FIG. 5A but also shows a plastic plug connector installed in a base portion of the shell.
Figure 6A:
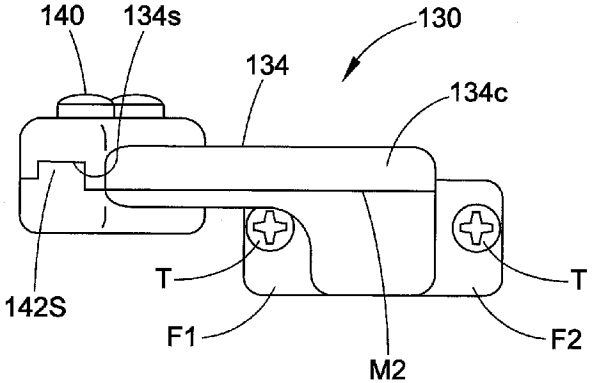
FIGS. 6A-6D are bottom, first side, top, and second side views of the empty connector shell of FIG. 5A; and, FIGS. 7A-7C are isometric views of a cable and show an alternative/optional process for preparing the cable for installation of a cable connector according to the present development.
Figure 6C:
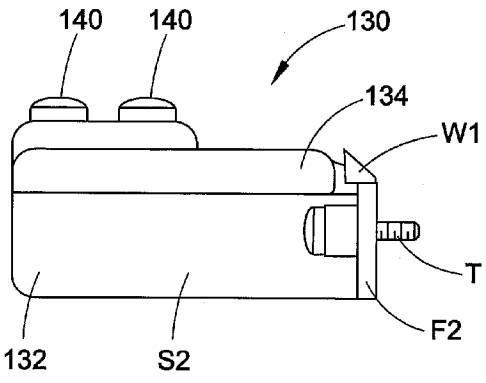
Figure 6B:
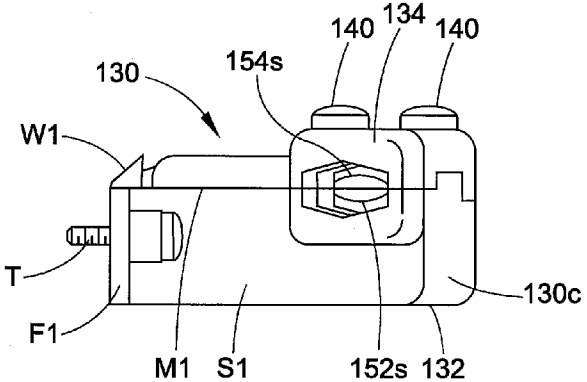
Figure 6D:
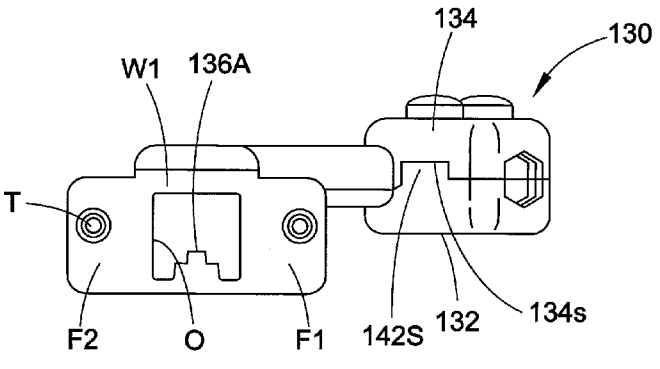

As shown in FIG. 5B, the recess R of the base 132 receives a polymeric ("plastic") plug connector 124. It can be seen in FIG. 5A (where the plug connector 124 is removed) that the recess R opens through the first end 132*a* of the base 132 such that a connector opening O is defined. This connector opening O can be defined through the flange F if the flange F is constructed to extend between the first and second side walls S1, S2, or the connector opening O is simply defined by an open space located between the side walls S1, S2 and the floor FL. The base 132 further comprises a first tab 136*a* that projects into the connector opening O to partially occlude the opening O, and comprises a second tab 136*b* that projects upwardly/outwardly from the floor FL at a location spaced from the connector opening O. The tab 136*b* is oriented transversely relative to the side walls S1, S2 and, in the illustrated embodiment, extends completely between the side walls S1, S2. Thus, between the first and second tabs 136*a*, 136*b*, and the first and second side walls S1, S2, the recess R defines a connector receiving location or seat 138 located adjacent the connector opening O and dimensioned to closely receive the plastic plug connector 124 with minimal clearance as shown in FIG. 5B so that the plastic plug connector 124 is captured in the notch/seat 138. The plastic plug connector 124 comprises two or more pin connectors 125*a*, 125*b* corresponding in number and conformed and dimensioned to mate respectively with the pin sockets 122*a*, 122*b* of the drive connector socket 120. When the plastic plug connector 124 is operably installed in the seat 138 of the base 132, the pin connectors 125*a*, 125*b* extend through the connector opening O and project outwardly away from the base 132 perpendicularly relative to the flange F. As shown in FIG. 4C, which is a section view of the connector 118 as taken at line C-C of FIG. 4, the first tab 136*a* is located adjacent and abuts a front transverse face 124*a* of the plastic connector 124 and the second tab 136*b* is located adjacent and abuts a rear transverse face 124*b* of the plastic plug 124.

As noted above, the shell comprises a cover 134 that is selectively releasably connected to the base 132 to define the overall shell 130. When the cover 134 is connected to the base 132, the shell defines an envelope surrounding the recess R for the terminal end 104*t* of the cable 104*a* located in the recess. Although the recess R is described as being defined in the base 132, when the cover 134 is connected to the base 132, the recess R is deemed to include the entire space enclosed by the shell 130. The cover 134 comprises a top wall 134*a* and first and second edges 134*b*, 134*c* that depend or project from the top wall 134*a* on opposite lateral sides thereof. The top wall 134*a* and its edges 134*b*, 134*c* are shaped and dimensioned to conform with the shape and dimensions of the base 132 such that the cover edges 134*bc*, 134*d* engage the edges E of the base side walls S1, S2 with a close fit such that first and second uninterrupted closed seams M1, M2 (see also FIGS. 6A-6D) are respectively defined between the sidewalls S1, S2 and the cover 134 when the cover is installed on the base 132. Referring again particularly to FIG. 4C, the cover 134 comprises at least one finger or tab 134*f* that projects downwardly/outwardly from the top wall 134*a* between the edges 134*b*, 134*c*. When the cover 134 is operably secured to the base 132, as shown in FIG. 5C, this tab 134*f* is in contact with a body portion 124*b* of the plastic plug connector 124 installed in the seat 138 of the recess R. The cover tab 134*f* presses and holds the body portion 124*b* of the plastic plug connector 124 into contact with the floor FL of the base 132 in the seat 138, which ensures that the plastic plug connector 124 cannot lift away from the floor FL and move over the second tab 136*b* and out of its seat 138.

The plastic plug connector 124 is electrically connected by a technician in the field to the signal conductors 110 of the signal cable 104*a* using suitable electrical connections that electrically connect each of the signal conductors 110 to one of the pin connectors 125*a*, 125*b* of the plug connector 124. In one embodiment, the plastic plug connector 124 comprising insert-to-connect sockets 126*a*, 126*b* that are respectively electrically connected to the pin connectors 125*a*, 125*b* and that allow a bare wire portion of a signal conductor 110 to be inserted therein to make the required electrical connection, each of which can be released by pressing a corresponding release button.

The cover 134 further comprises a tongue 134*t* that projects from a first end 134*a*. To operably install the cover 134 on the base 132, this tongue 134*t* is inserted into a corresponding groove or notch G defined by the base 132 adjacent the connector opening O at the first end 132*a* of the base. As shown in FIGS. 5A and 4C, the base 132 comprises a first or front wall W1 that extends between the side walls S1, S2 and that defines an upper edge of the connector opening O, and the groove/notch G for the tongue 134*t* of the cover 134 is defined in/by this front wall. The opposite, second end of the cover 134 is secured to the base 132 by one or more screws or other threaded fasteners 140 that extend through the top wall 134*a* and that are threaded into respective tapped bores 142 defined by the base 132. Alternatively, the threaded fasteners 140 are replaced by one or more clips or other fasteners that selectively engage a mating portion of the base 132 to fixedly secure the second end of the cover 134 to the base 132.

To install the cover 134 on the base 132, the tongue 134*t* is inserted into the groove G, and the remainder of the cover 134 is placed in covering relation with the recess R of the base, with the edges 134*b*, 134*c* of the cover mated with the side wall edges E to define the seams M1, M2. In the illustrated embodiment, the base 132 comprises first and second bosses 142*s* in which the threaded bores 142 for the fasteners 140 are defined, with each boss 142*s* located adjacent one of the edges E. These bosses 142*s* are raised relative to the respectively adjacent edge E so that they project upward/outward there from. The mating edges 134*b*, 134*c* of the cover include corresponding locating notches 134*s* that closely fit over the bosses 142*s* when the cover 134 is operably installed on the base 132. This mating engagement of the bosses 142*s* with the cover locating notches 134*s* ensures that the cover 134 is properly aligned with the base 132 when the cover is installed on the base.

Referring to FIG. 4D, which is a section view taken at D-D of FIG. 4, the shell 130 comprises a cable shield electrical contact structure or portion 150 located in the recess R that provides up to 360 degrees of electrical contact between the shell 130 and an exposed portion of the electrical shield 112 encircling the signal conductors 110. In the illustrated embodiment, the shell base 132 includes a first shield contact portion provided by a cable cradle 152 comprising an arcuate or otherwise curved cradle surface 152*s* for contacting a first circumferentially extending portion/surface of the electrical shield 112. The shell cover 134 includes a corresponding second shield contact portion provided by a cable saddle 154 comprising an arcuate or otherwise curved saddle surface 154*s* or includes another structure adapted to engage a second circumferentially extending portion/surface of the electrical shield 112 of the stripped cable portion 104*a* supported on the cradle surface 152*s*. When the cover 134 is installed on the base 132, the cradle surface 152*s* and saddle surface 154*s* are located in opposed facing relation in order to substantially encircle preferably up to 360 degrees of an exposed portion of the sheath 112 of the signal conductor cable 104*a* that is located between the cradle and saddle 152, 154. Alternatively, the cradle 152 and saddle 154 are axially offset from each other in terms of the longitudinal axis of the cable 104*a* such that they are not axially aligned with each other.

Figure 7A:
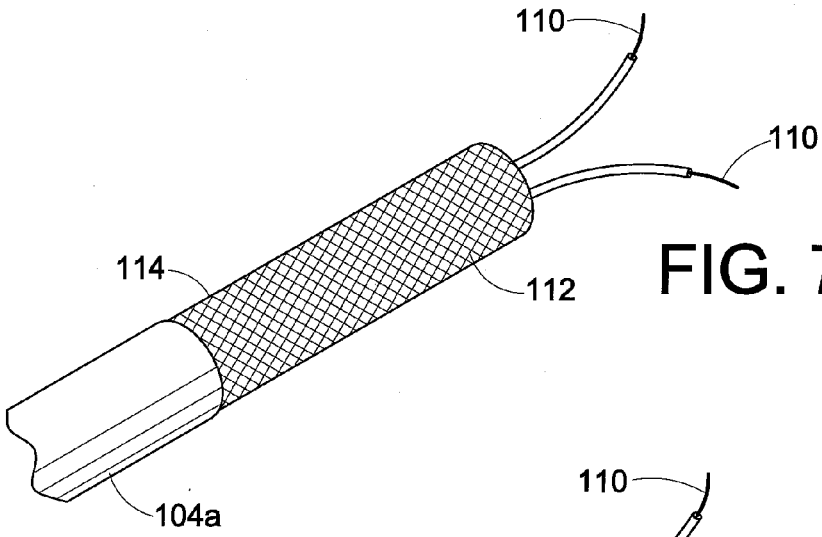

As noted, the shell 130 is field installable on the control signal cable 104*a*. To install the shell 130, the cover 134 (if installed) is removed from the base 132 by removing/releasing the fasteners 140 and lifting the cover 134 away from the base 132 to open the recess R. The plastic plug connector 124 including the signal conductors 110 electrically connected thereto is inserted into the seat 138 of the recess R, with its pin connectors 125*a*, 125*b* extending through the connector opening O (alternatively, the plastic plug connector 124 can be placed in the seat 138 before the signal conductors 110 are connected thereto). A sufficient portion of the external insulation sheath 114 is removed from the signal conductor cable 104*a* to expose the electrical shield 112 at the cable shield electrical contact portion 150 (cradle 152/saddle 154) of the shell 130, but the external insulation sheath 114 is left intact from a location inside the mouth 130*c* of the shell 130 and extending out of the mouth 130*c* of the shell 130 (an example of a suitably prepared cable 104*a* is shown in FIG. 7A). The cable 104*a* is laid in the recess R and its exposed electrical shield 112 is laid on the cradle surface 152*a* and the cable 104*a* is fed through the mouth recess 132*m* of the base 132. The cover 134 is then connected to the base 132, to enclose the plastic plug connector 124 and capture it in the seat 138 of the recess R and to enclose the associated end of the signal conductor sub-cable 104*a* in the recess R and to provide EMI electrical shielding around the perimeter of the plastic plug connector 124 and around the circumference of the associated end of the signal conductor sub-cable 104*a* engaged with the plastic plug connector 124. The cover 134 is secured to the base 132 by engagement of its tongue 134*t* with the groove G of the base 132, and by engaging the fasteners 140 with the base 132. When the fasteners 140 are engaged with the base to secure the cover 134, the cradle surface 152*s* and the saddle surface 154*s* are located in contact with the cable electrical shield 112 as shown in FIG. 4D to provide an electrical termination for the shield 112 through the shell 130. In another alternative embodiment, the shell 130 includes other means for electrically terminating the electrical shield 112 through the shell 130. In one example, the base 132 and/or cover 134 include vampire contacts that pierce the external insulation 114 of the control signal cable 104*a* to make electrical contact with and terminate the electrical shield 112.

Thus, with the cover 134 operably connected to the base 132, the cradle surface 152*s* and the saddle surface 154*s* together encircle and contact around the circumference of the electrical shield 112 of the sub-cable 104*a* to electrically connect the electrical shield 112 to the shell 130. When the connector 118 is operably engaged with the drive connector socket 120 of the drive 12, the pin connectors 125*a*, 125*b* of the connector 118 are respectively mated with the header pin sockets 122*a*, 122*b* of the connector socket, and the flanges F1, F2 of the shell 130 are abutted with and electrically connected to the front face 126*c* of the shroud 126 so that the connector 124 and its pins 125*a* and 125*b* are encircled preferably with 360 degrees of conductive shielding material to provide a low impedance connection of the cable shield to the shroud 126. The shroud 126 is grounded through its ground pins 126*g* to a ground connection of the circuit board B or another ground path of the drive 12. The threaded fasteners T captured to each flange F1, F2 are advanced into the connector securement apertures 122*x*, 122*y* of the connector socket 120 to secure the connector 118 to the connector socket 120. The connector securement apertures 122*x*, 122*y* include metal thread inserts that are not necessarily grounded through the circuit board B or otherwise, but they could be. However, any threaded metal inserts used in the connector securement apertures 122*x*, 122*y* are grounded through fasteners T and the shell 130 when the connector 118 is mated with the connector socket 120 and the fasteners T are advanced into the securement apertures 122 of the connector socket 120.

Figure 7B:
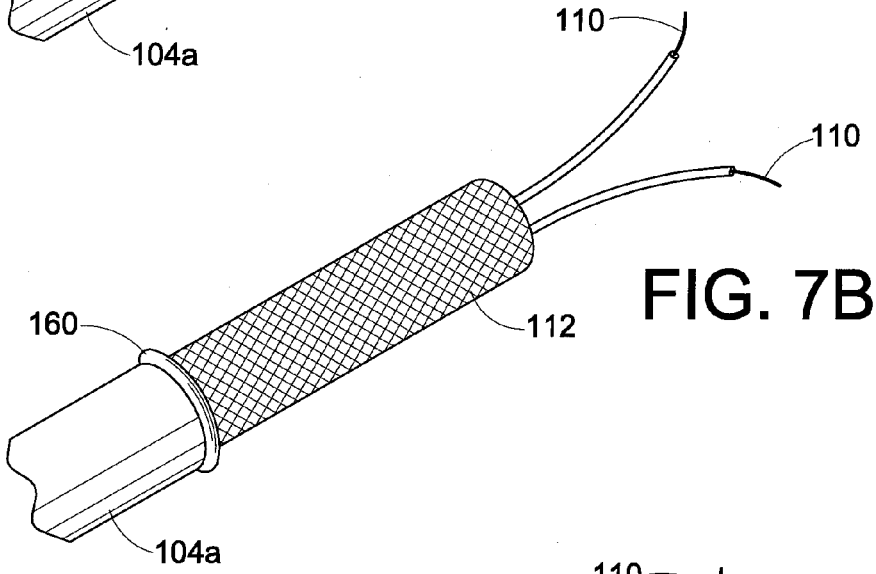
Figure 7C:
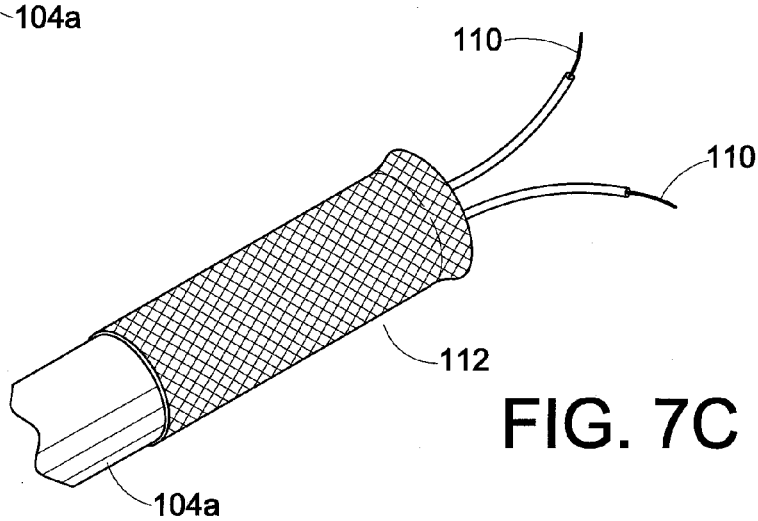

FIGS. 7A-7C illustrate and optional process for preparing the control signal cable portion 104*a* of the hybrid cable 104 to have the backshell connector 118 installed thereon. FIG. 7A illustrates the cable 104*a* prepared to have the connector 118 installed as described above. Optionally, a ring or ferrule 160 is inserted over the exposed electrical shield 112, and the electrical shield 112 is folded back upon itself and the ferrule 160 to define a protuberance 162 where the electrical shield 112 covers the ferrule 160. This protuberance 162 is then engaged with the cradle 152 or a similar structure.

It will be appreciated that the connector 118 provides a complete Faraday shield around the control signal conductors 110 and the plastic connector 124 between the control signal cable 104*a* and the connector socket 120 of the drive 12, along with mechanical termination of the control signal cable 104*a*. Importantly, the conductors of 110 are surrounded by electrical shielding material up to a 360 degrees around the signal conductors, is established between the metallic shell 130, which is grounded through the drive connection socket 120, and the electrical shield 112 of the control signal cable 104*a* as required to provide a low impedance connection of the shield to shunt electrical noise introduced on the cable shield, connector backshell and shroud to ground to resist electrical interference.

It should be noted that a main advantage of the present development is that the plastic socket header 122 by itself can be a known or standard part that can be used without any EMI shielding, but that is converted to a EMI shielded drive connector socket 120 by installing or including a metal shroud 126 according to the present development as shown in FIGS. 2, 2A, and 3. Likewise, the plastic plug connector 124 that terminates the control cable 104*a* can be a known component usable by itself without any EMI shielding properties, but that is converted to an EMI shielded connector 118 by installing the shell 130 according to the present development as described herein. The development has been described with reference to preferred embodiments. Those of ordinary skill in the art will recognize that modifications and alterations to the preferred embodiments are possible. The disclosed preferred embodiments are not intended to limit the scope of the following claims, which are to be construed as broadly as possible, whether literally or according to the doctrine of equivalents.

The invention claimed is:

1. A servo motor drive system comprising:

a servo motor drive comprising a drive connector socket and a shielded control signal cable including a connector engaged with said drive connector socket, said shielded control signal cable comprising an electrical shield surrounding control signal conductors and said connector comprising a backshell that establishes an electromagnetic interference shield envelope around said control signal conductors, wherein said connector backshell and said drive connector socket cooperate to provide a low impedance electrical connection path from said electrical shield of said control signal cable to a ground path of said servo motor drive;

said connector backshell comprising:

a metallic shell comprising a base and a cover connected to said base, said base comprising a recess and said shell defining an envelope around said recess when said cover is operably connected to said base;

said shell further comprising a first end including a connector opening that opens through said shell into a first portion of said recess and including a mouth that opens through said shell into a second portion of said recess, wherein a terminal end of said control signal cable passes into said recess through said mouth;

said shell further comprising first and second flanges located adjacent said first end and projecting laterally outward in opposite first and second directions, respectively, said first and second flanges comprising respective first and second fasteners engaged with the drive connector socket;

said first portion of said recess located adjacent said connector opening comprising a connector seat including a portion of a floor of said shell base, said connector seat located between first and second spaced-apart side walls of said base that project outwardly on opposite sides of said floor, said connector seat supporting said connector, with a projecting plug portion of said connector projecting through said connector opening outside said shell;

wherein a portion of said cover of said shell contacts the connector when the cover is connected to said base;

said shell further comprising an electrical shield contact structure located in said recess and adapted for contacting the electrical shield surrounding the control signal cable terminal end located in said recess and electrically connecting the electrical shield to the shell such that said shell defines an electromagnetic interference shield around the control signal cable terminal end.

2. The servo motor drive system as set forth in claim 1, wherein said cover of said shell comprises a tongue that projects from a first end of the cover, and said base of said shell comprises a groove located adjacent said connector opening that receives and retains the tongue of the cover when said cover is connected to said base.

3. The servo motor drive system as set forth in claim 1, wherein said base of said shell further comprises:

a first tab that projects into said connector opening to partially obstruct said connector opening.

4. The servo motor drive system as set forth in claim 3, wherein said base of said shell further comprises:

a second tab spaced from said first tab and projecting from said floor between said first and second sidewalls, wherein said connector seat is defined between said first and second tabs, and wherein said portion of said cover that contacts the plug connector located on said seat urges the plug connector into abutment with the floor between the first tab and the second tab.

5. The servo motor drive system as set forth in claim 4, wherein said cover of said shell comprises a top wall and first and second edges that project from said top wall on opposite lateral sides of said top wall, wherein said portion of said cover adapted to contact the plug connector located on said seat comprises a finger connected to said top wall and located between the first and second edges of the cover.

6. The servo motor drive system as set forth in claim 5, wherein a second end of said cover is secured to said base of said shell by at least one removable fastener engaged with said cover and said base.

7. The servo motor drive system as set forth in claim 1, wherein said electrical shield contact structure comprises a first portion connected to said base of said shell including a cradle surface for supporting the cable terminal end and for contacting a first circumferentially extending region of the electrical shield of the cable terminal end.

8. The servo motor drive system as set forth in claim 7, wherein said electrical shield contact structure comprises a second portion connected to said cover of said shell and including a saddle surface for contacting a second circumferentially extending region of the electrical shield of the cable terminal end.

9. The servo motor drive system as set forth in claim 8, wherein said cradle surface and said saddle surface together are adapted to contact 360 degrees of the electrical shield of the cable terminal end located in the recess.

10. The servo motor drive system as set forth in claim 9, wherein said cradle surface and said saddle surface are axially aligned with each other along an axis of the cable terminal end.

11. The servo motor drive system as set forth in claim 9, wherein said cradle surface and said saddle surface are axially offset from each other along an axis of the cable terminal end.

12. A servo motor drive system comprising:

a servo motor drive comprising a drive connector socket and a shielded control signal cable including a backshell connector engaged with said drive connector socket, said shielded control signal cable comprising an electrical shield surrounding control signal conductors, wherein said backshell connector establishes an electromagnetic interference shield envelope around said control signal conductors, and wherein said backshell connector and said drive connector socket cooperate to provide a low impedance electrical connection path from said electrical shield of said control signal cable to a ground path of said servo motor drive;

said drive connector socket comprising:

a plastic connector header including connector pin sockets located in a front face; and, a metal shroud that provides an electromagnetic interference shield for said plastic connector header, said metal shroud comprising first and second spaced-apart side walls that cover left and right sides of the plastic connector header, a rear wall that covers a rear surface of the plastic connector header, a top wall that covers a top surface of said plastic connector header, and a front wall that covers part of the front face of said plastic connector header, said front wall of said metal shroud including a window that provides access to said connector pin sockets in said front face of said plastic connector header, wherein said metal shroud includes at least one ground connection to a ground path associated with said servo motor drive;

said backshell connector of said control signal cable comprising:

a metallic shell comprising a base and a cover connected to said base, said base comprising a recess and said shell defining an envelope around and enclosing said recess when said cover is operably connected to said base;

said shell further comprising a first end including a connector opening that opens through said shell into a first portion of said recess and including a mouth that opens through said shell into a second portion of said recess, wherein a terminal end of said control signal cable extends through said mouth into said recess and a plastic plug connector operably engaged with first and second control signal conductors of the control signal cable is located in said recess with a plug portion thereof projecting out of said shell through said connector opening and operably mated with said pin sockets of said drive connector socket;

wherein said first end of said shell is abutted with said front wall of said metal shroud of said connection socket to complete a low impedance ground path between said shell and said metal shroud;

said shell further comprising an electrical shield contact structure located in said recess and adapted for contacting an electrical shield surrounding the cable terminal end located in said recess, said electrical shield contact structure electrically connecting the electrical shield of the cable to the shell such that said shell defines an electromagnetic interference shield around the cable terminal end located in said recess, and such that said electrical shield of said cable is grounded through said shell to said metal shroud of said drive connector socket.

13. The servo motor drive system as set forth in claim 12, wherein said shell of said connector further comprises first and second flanges located adjacent said first end and projecting laterally outward in opposite first and second directions, respectively, said first and second flanges comprising respective first and second captured fasteners that are engaged with the connector socket through first and second apertures defined in said front wall of said metal shroud, wherein said first and second flanges of said shell are abutted with said front wall of said metal shroud of said connection socket on opposite sides of said connector pin sockets to complete a ground path between said shell and said metal shroud.

14. The servo motor drive system as set forth in claim 12, wherein said first portion of said recess located adjacent said connector opening comprises a connector seat comprising a portion of a floor of said shell base, said connector seat located on said floor between first and second spaced-apart side walls of said base that project outwardly on opposite sides of said floor, wherein the plug connector on the cable terminal end is located on said connector seat, wherein a portion of said cover of said shell is adapted to contact the plug connector located on said seat when the cover is connected to hold said plug connector on said seat.

15. The servo motor drive system as set forth in claim 12, wherein the plastic connector header and the plastic plug connector are intended for use on their own without EMI shielding.

16. The servo motor drive system as set forth in claim 12, wherein said electrical shield contact structure comprises a first portion connected to said base of said shell and comprising a cradle surface for supporting the associated cable terminal end and for contacting a first circumferentially extending region of the electrical shield of the associated cable terminal end.

17. The servo motor drive system as set forth in claim 16, wherein said electrical shield contact structure comprises a second portion connected to said cover of said shell and comprising a saddle surface for contacting a second circumferentially extending region of the electrical shield of the associated cable terminal end.

18. The servo motor drive system as set forth in claim 12, wherein said base of said shell further comprises a first tab that projects into said connector opening to partially obstruct said connector opening.

19. The servo motor drive system as set forth in claim 18, wherein said base of said shell further comprises:

a second tab spaced from said first tab and projecting from said floor between said first and second sidewalls, wherein said connector seat is defined between said first and second tabs, and wherein said portion of said cover that contacts the plug connector urges the plug connector into abutment with the floor between the first tab and the second tab.

20. The servo motor drive system as set forth in claim 12, wherein said cover of said shell comprises a tongue that projects from a first end of the cover, and said base of said shell comprises a groove located adjacent said connector opening that receives and retains the tongue of the cover when said cover is connected to said base.

21. The servo motor drive system as set forth in claim 20, wherein a second end of said cover is secured to said base of said shell by at least one removable fastener engaged with said cover and said base.

* * * * *